US007537386B2

(12) United States Patent
Linton et al.

(10) Patent No.: US 7,537,386 B2
(45) Date of Patent: May 26, 2009

(54) TAMPER-EVIDENT FEATURE FOR SLIDER-OPERATED RECLOSABLE PACKAGING

(75) Inventors: Basil C. Linton, Loganville, GA (US); Gregory H. Crunkleton, Nicolson, GA (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 712 days.

(21) Appl. No.: 11/166,521

(22) Filed: Jun. 23, 2005

(65) Prior Publication Data

US 2006/0291754 A1 Dec. 28, 2006

(51) Int. Cl.
*B65D 33/16* (2006.01)
*A44B 19/38* (2006.01)

(52) U.S. Cl. ..... 383/64; 383/5; 383/61.2; 383/61.3; 24/388

(58) Field of Classification Search ..... 383/64, 383/5, 61.2, 202, 210, 211; 24/436, 387, 24/388, 415, 381, 30.5, 400; 53/412, 133.4, 53/139.2; 493/213, 927; *B65D 33/16, 33/14, B65D 33/18, 33/1634*

See application file for complete search history.

(56) References Cited

U.S. PATENT DOCUMENTS 4,584,706 A 4/1986 Ausnit
5,189,764 A * 3/1993 Herrington et al. ..... 24/384
5,566,429 A * 10/1996 Martinez et al. ..... 24/585.12
5,669,715 A * 9/1997 Dobreski et al. ..... 383/5
5,775,812 A * 7/1998 St. Phillips et al. ..... 383/5
6,036,796 A * 3/2000 Halbert et al. ..... 156/64
6,247,843 B1 * 6/2001 Buchman ..... 383/5
6,287,000 B1 * 9/2001 Buchman ..... 383/5
6,431,754 B1 * 8/2002 Savicki, Sr. ..... 24/387
6,439,770 B2 * 8/2002 Catchman ..... 383/5
6,481,890 B1 * 11/2002 VandenHeuvel ..... 383/64
6,488,410 B2 * 12/2002 Schneider ..... 383/5
6,712,509 B2 3/2004 Cappel
2002/0071617 A1 * 6/2002 Bois ..... 383/5
2006/0008187 A1 * 1/2006 Armstrong ..... 383/103
2006/0228054 A1 * 10/2006 Anzini et al. ..... 383/61.2

* cited by examiner

*Primary Examiner*—Nathan J Newhouse
*Assistant Examiner*—Matt Benvenuti
(74) *Attorney, Agent, or Firm*—Ostrager Chong Flaherty & Broitman P.C.

(57) ABSTRACT

A reclosable package comprises a receptacle having first and second walls, respective mouth portions of the front and rear walls forming a mouth that communicates with an interior volume of the receptacle; a zipper having mutually interengageable zipper strips, one zipper strip being joined to the mouth portion of the front wall and the other zipper strip being joined to the mouth portion of the rear wall; a slider mounted to the zipper, the slider initially being parked in a position whereat the zipper is closed along a majority of its length; and a tack seal that resists movement of the slider in an opening direction from the initially parked position. The tack seal is designed to rupture and no longer resist slider movement when a predetermined threshold level of force is exerted by the slider.

8 Claims, 7 Drawing Sheets

TAMPER-EVIDENT FEATURE FOR SLIDER-OPERATED RECLOSABLE PACKAGING

BACKGROUND OF THE INVENTION

This invention generally relates to the provision of tamper-evident features in reclosable packaging, such as bags or pouches. In particular, the invention relates to features that indicate whether a slider on a slider-operated reclosable package has been tampered with.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interengageable profiled closure strips that are joined at opposite ends of the bag mouth. The profiles of interengageable plastic zipper strips can take on various configurations, e.g. interlocking rib and groove elements having so-called male and female profiles, interlocking alternating hook-shaped closure elements, interlocking ball-shaped closure elements, etc. Reclosable bags having slider-operated zippers are generally more desirable to consumers than bags having zippers without sliders because the slider eliminates the need for the consumer to align the interengageable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag-making film, for example, by conduction heat sealing. These separate closure strips typically have flanges extending therefrom in such a way that the flanges can be joined to bag-making film in order to attach the closure strips to the film. Previous slider-operated, separately extruded zippers used flange-type constructions.

An alternative zipper design is the so-called flangeless or string zipper, which has substantially no flange portion above or below the interengageable closure profiles. In the case of a string zipper, the bag-making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

Various additions to reclosable bags have been made to provide tamper-evident seals or indicators that will reveal when the bag has been opened or otherwise tampered with prior to purchase by the consumer. It is known to provide a reclosable package construction that is designed to undergo some permanent change in the package appearance when the package is opened for the first time. For example, it is known to provide a reclosable package with a tamper-evident, non-reclosable peel seal that gives a positive indication of having been broken when a package is first opened. It is also known to shroud the zipper (with or without slider) inside an enclosed header on the top of the bag. Another type of tamper-evident feature is the provision of a membrane on the product side of the zipper that partitions the interior volume in an airtight manner.

It is also known to provide a slider-operated reclosable bag in which a tamper-evident feature initially maintains the slider at a position corresponding to full closure of the zipper and allows the slider to move away from the closed position to start to open the zipper in response to removal of or breaking of the tamper-evident feature. Numerous embodiments of tamper-evident features that must be removed or broken before the slider can be moved to the zipper opened position are disclosed in U.S. Pat. No. 6,712,509.

There is a continuing need for new designs for slider-operated reclosable bags with tamper-evident features that can be manufactured at low cost.

BRIEF DESCRIPTION OF THE INVENTION

The present invention is directed to the provision of a tamper-evident feature on slider-operated reclosable bags. The tamper-evident feature is provided by forming a tack seal or zone of fusion that resists movement of the slider to a position whereat the zipper would be opened enough to allow tampering with the contents of the package.

One aspect of the invention is a reclosable package comprising: a receptacle comprising first and second walls, respective mouth portions of the first and second walls forming a mouth that communicates with an interior volume of the receptacle; a zipper comprising mutually interengageable first and second zipper strips, the first zipper strip being joined to the mouth portion of the first wall and the second zipper strip being joined to the mouth portion of the second wall; a slider mounted to the zipper for causing the first and second zipper strips to separate when the slider is moved in one direction along the zipper and for causing the first and second zipper strips to interengage each other when the slider is moved in an opposite direction along the zipper, the slider initially being parked in a position whereat the zipper is closed along a majority of its length; and a tack seal that provides resistance to movement of the slider in a direction from the initially parked position toward a position whereat the zipper is opened along a majority of its length, the tack seal being designed to rupture and no longer provide resistance to the slider movement when a predetermined threshold level of force is exerted by the slider.

Another aspect of the invention is a reclosable package comprising: a receptacle comprising first and second walls, respective mouth portions of the first and second walls forming a mouth that communicates with an interior volume of the receptacle; a zipper comprising mutually interengageable first and second zipper strips, the first zipper strip being joined to the mouth portion of the first wall and the second zipper strip being joined to the mouth portion of the second wall; a slider mounted to the zipper for causing the first and second zipper strips to separate when the slider is moved in one direction along the zipper and for causing the first and second zipper strips to interengage each other when the slider is moved in an opposite direction along the zipper, the slider initially being parked in a position whereat the zipper is closed along a majority of its length; and a rupturable zone of fusion located to provide resistance to movement of the slider in a direction from the initially parked position toward a position whereat the zipper is opened along a majority of its length, the zone of fusion being designed to rupture and no longer provide resistance to the slider movement when a predetermined threshold level of force is exerted by the slider.

A further aspect of the invention is a method of providing a tamper-evident feature on a reclosable package, comprising the following steps: forming a receptacle comprising first and second walls, respective mouth portions of the first and second walls forming a mouth that communicates with an interior volume of the receptacle; joining a first zipper strip to the mouth portion of the first wall; joining a second zipper strip to the mouth portion of the second wall; mounting a slider onto the first and second zipper strips; and forming a rupturable zone of fusion located to provide resistance to movement of the slider in a direction from an initially parked position whereat the zipper is closed along a majority of its length toward a position whereat the zipper is opened along a majority of its length, the zone of fusion being designed to rupture and no longer provide resistance to the slider movement when a predetermined threshold level of force is exerted by the slider.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
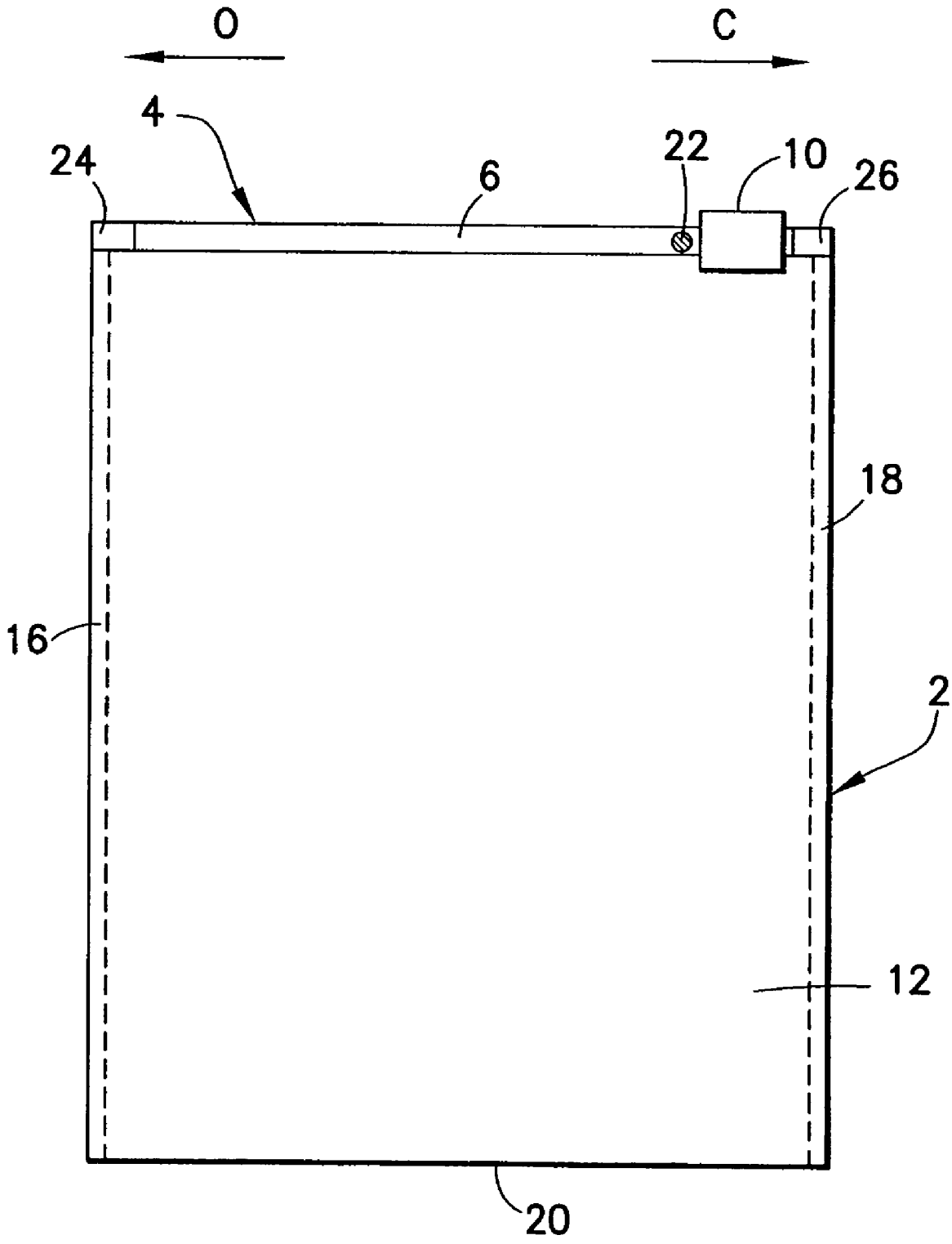
FIG. 1 is a drawing showing a slider-operated reclosable package wherein the zipper strips are tack sealed together to form a tamper-evident feature that limits travel of the slider in accordance with various embodiments of the invention. Two such embodiments are shown in greater detail in FIGS. 2 and 3.

A reclosable package comprising a receptacle 2 and a flexible plastic string zipper 4 operated by manipulation of a slider 10 is shown in FIG. 1. It should be understood that the slider-zipper assemblies disclosed herein can be installed in a reclosable package of the type shown in FIG. 1 or other types of reclosable packages having different structures, e.g., gusseted bags, bags with a block bottom, thermoformed packages, etc.

The receptacle 2 may be made from any suitable film material, including thermoplastic film materials such as low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less. The receptacle 2 comprises opposing walls (only the front panel 12 is visible in FIG. 1) that may be secured together at opposite side edges of the receptacle by seams 16 and 18 (indicated by dashed lines). The opposing bottoms of the walls may be joined, for example, by means of a heat seal made in conventional fashion, e.g., by application of heat and pressure. Typically, however, the bottom of the package is formed by a fold 20 in the original packaging film, as depicted in FIG. 1.

At its top end, the receptacle 2 has an openable mouth, on the inside of which is an extruded plastic string zipper 4. The string zipper 4 comprises a pair of interengageable zipper strips. One zipper strip 6 is visible in FIG. 1. The profiles of the zipper strips may take any form. For example, the string zipper may comprise interlocking rib and groove elements or alternating hook-shaped closure elements or combinations thereof. The preferred zipper material is polyethylene. The upper margins of the front and rear bag walls are respectively sealed to the backs of the respective zipper strips by a conventional conduction heat sealing technique.

The string zipper is operated by sliding the slider 10 along the zipper strips. As the slider moves across the zipper, the zipper is opened or closed. As shown in FIG. 1, the slider is slidable along the zipper in a closing direction "C", causing the zipper strips to become engaged, or in an opening direction "O", causing the zipper strips to become disengaged. Although not visible in FIG. 1, the slider 10 is of the type having a plow or separating finger for prying the closure profiles of the zipper apart as the slider is moved in the opening direction. FIG. 1 shows the slider 10 in a parked position corresponding to the zipper being fully closed.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or acrylonitrile butadiene styrene.

In accordance with the embodiments generally depicted in FIG. 1, the zipper strips are tack sealed together to form a tamper-evident feature that limits travel of the slider 10 as long as the tack seal remains intact. More precisely, the intact tack seal 22 will block the passage of the slider's separating finger or plow 42 between the zipper strips. However, the tack seal is designed to rupture when the separating finger bears against the tack seal and is pushed through with a certain amount of force, which level of force should be greater than the amount of force typically applied by the consumer as he/she grasps the slider and pulls it in the zipper opening direction. Prior to opening of the package by the consumer, the consumer may test the tack seal to ensure that it is intact by pulling the slider in the zipper opening direction with the customary amount of force and, if the tack seal is intact, meeting resistance. When the consumer senses the resistance provided by the intact tack seal, he/she can be assured that the slider has not been previously used to open the package. FIG. 1 shows a circular tack seal 22, but other geometric shapes (e.g., square, triangular or elliptical) may be employed.

While FIG. 1 shows the tamper-evident tack seal 22 being disposed ahead of the slider, a person skilled in the art will appreciate that the tack seal need only be ahead of the separating finger or plow 42, meaning that a portion of the slider in the fully closed park position could overlap the tack seal, such as in the case wherein the separating finger is positioned inside the slider.

The package shown in FIG. 1 further comprises end stops 24 and 26 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the receptacle from opening in response to stresses applied to the profiles through normal use of the bag. In accordance with one embodiment of the invention, the end stops comprise stomped areas on the zipper strips themselves. The stomped end stops comprise sections of the zipper strips that have been fused together and flattened at the ends of the zipper.

Figure 2:
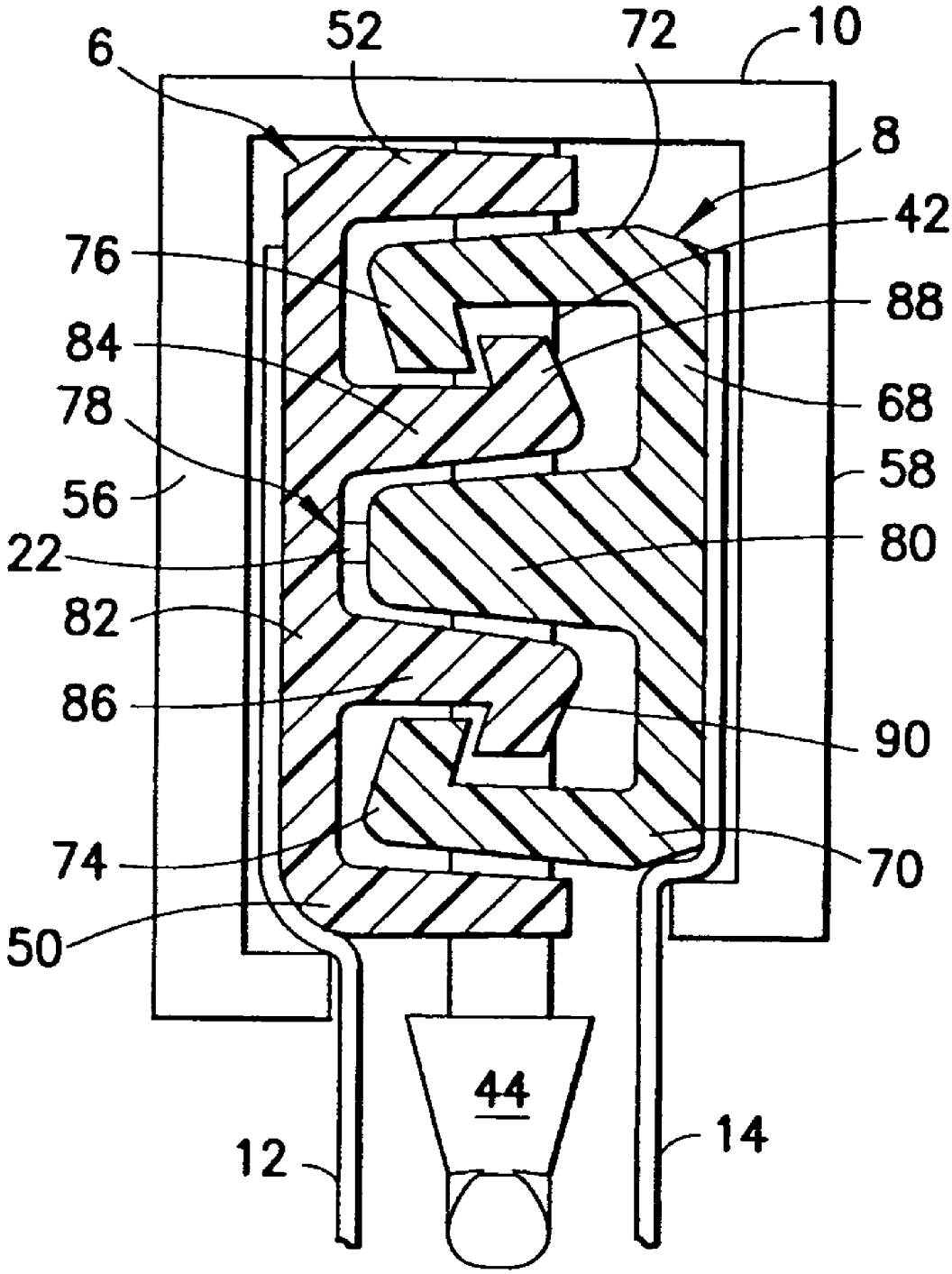
FIG. 2 is a drawing showing a sectional view of the zippered portion of a slider-operated reclosable package wherein the zipper strips are tack sealed together to form a tamper-evident feature that limits slider travel in accordance with one embodiment of the invention.

A string zipper design in accordance with a first embodiment of the present invention is depicted in FIG. 2. This string zipper comprises a pair of flangeless zipper strips 6 and 8, each of which is an extruded plastic part having a generally constant profile along its length. The backs of the flangeless zipper strips 6, 8 are joined to the marginal portions of respective walls 12, 14 (shown in part) of the receptacle, and a slider 10 having a separating finger or plow 42 is mounted to the string zipper with the joined portions of the receptacle walls 12,14 passing between the slider sidewalls 56 and 58.

Still referring to FIG. 2, the zipper strip 6 comprises a base 82 and first and second hooked elements 84 and 86 projecting from that base, each hooked element having a respective hook flange or detent 88 and 90 at its distal end. The zipper strip 8 comprises first and second hooked elements 70 and 72 projecting from the bottom and top respectively of a base 68. The hook flanges 88, 90 of hooked elements 84, 86 project away from each other; the hook flanges 74, 76 of hooked elements 70, 72 project toward each other. When the string zipper is closed (as depicted in FIG. 2), the hooked elements 84 and 86 of zipper strip 6 are disposed between the hooked elements 70 and 72 of zipper strip 8 in interengaging relationship. The engagement of hook flange 88 with hook flange 76 and of hook flange 90 with hook flange 74 clasps the zipper strips in interlocking relationship.

The flangeless zipper strip 6 shown in FIG. 2 also comprises first and second backup flanges 50 and 52 projecting substantially perpendicularly from the opposing ends of the base 82 and respectively overlapping the hooked elements 70 and 72 of zipper strip 8 in backup relation. The hooked element 84 and the backup flange 52 define a groove that receives the hooked element 72 of the flangeless zipper strip 8; and the hooked element 86 and the backup flange 50 define a groove that receives the hooked element 70 of flangeless zipper strip 8.

The zipper design shown in FIG. 2 is provided with a self-alignment feature in the form of a large centrally located rib 80 that projects from the base 68 of flangeless zipper strip 8 into a channel 78 defined by the backs of hooked elements 84 and 86 of flangeless zipper strip 6. The rib 80 has tapered side surfaces. Likewise the channel 78 has tapered surfaces. Alignment of the flangeless zipper strips as they are pressed together is facilitated by the rib 80 interacting with the sides of the channel 78. The rib 80 is sized and shaped to fit snugly in the channel 78 during zipper closure. As a result, the rib's tapered surfaces abut against the hooked elements 84 and 86 so as to prevent inadvertent opening of the zipper.

In accordance with the embodiment depicted in FIG. 2, a tamper-evident tack seal 22 is formed by fusing a portion of the face of the central rib 80 of zipper strip 8 to a confronting portion of the surface of the base 82 of zipper strip 6. The area of fusion is a spot having any suitable geometric shape, although the simplest and preferred shape is circular. Such a circular area of fusion may be formed by pressing the end of a heated pin or the end of an ultrasonic horn against the back of the zipper strip 6 opposite the area where tack seal 22 is shown in FIG. 2. The pressure exerted by the heated pin or ultrasonic horn will be resisted by an opposing bar or anvil abutting the back of the zipper strip 8. During the manufacturing process, one tack seal will be formed for every package-length section of the string zipper. The tack seals can be formed before or after the packaging film is joined to the backs of the zipper strips.

As previously noted, the tack seal 22 limits travel of the slider 10 as long as the tack seal remains intact. However, the tack seal is designed to rupture when the separating finger bears against the tack seal and is pushed through with an amount of force that exceeds the force customarily needed to move the slider in a zipper opening direction. When the consumer senses the resistance provided by the intact tack seal 22, he/she can be assured that the slider has not been previously operated to open the package.

Figure 3:
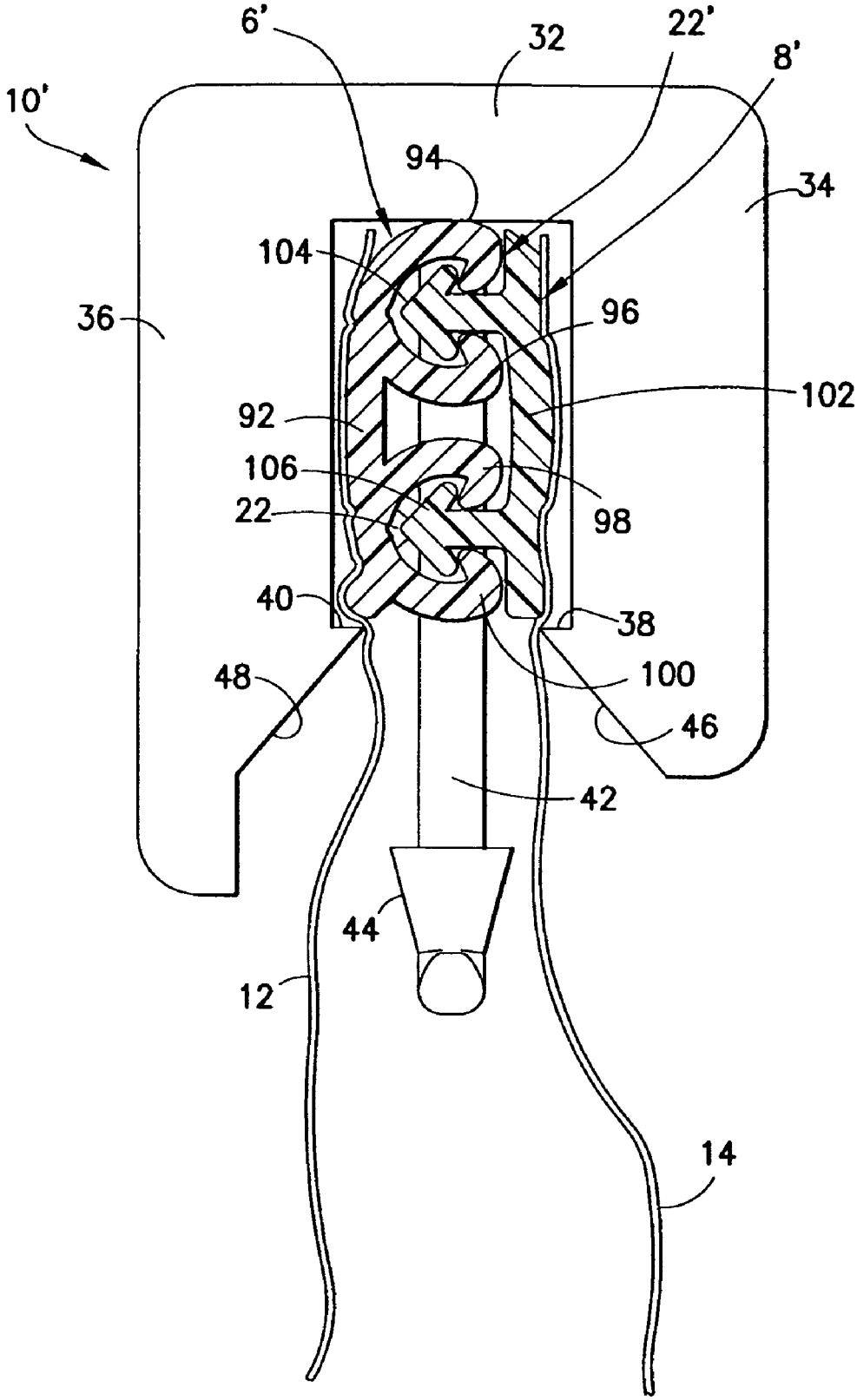
FIG. 3 is a drawing showing a sectional view of the zippered portion of a slider-operated reclosable package wherein the zipper strips are tack sealed together to form a tamper-evident feature that limits slider travel in accordance with another embodiment of the invention.

Another embodiment of a string zipper suitable for use in the present invention is seen in FIG. 3. Numerals 12 and 14 indicate opposing walls (made, e.g., of plastic film) of a receptacle. The walls 12 and 14 of the receptacle are joined to the zipper parts 6' and 8', e.g., by heat sealing. The zipper in this example is an extruded plastic structure comprising mutually interlockable profiled zipper parts 6' and 8'. Zipper part 8' comprises a base and two generally arrow-shaped rib-like male closure elements or members 104 and 106 projecting from a base 102, and zipper part 6' comprises two pairs of hook-shaped gripper jaws connected by a sealing bridge 92. The pairs of gripper jaws form respective complementary female profiles for receiving the male profiles of closure elements 104 and 106. More specifically, jaws 94 and 96 receive and interlock with the male element 104, while jaws 98 and 100 receive and interlock with the male element 106. Alternatively, one zipper part could have one male profile and one female profile, while the other zipper part has one female profile and one male profile, or the respective zipper parts could each have more than two male or female profiles.

Still referring to FIG. 3, the sealing bridge 92 and the base 102 are resiliently flexible self-supporting structures having a thickness greater than the thickness of the bag film. The male closure elements are integrally formed with the base 102, while the female closure elements are integrally formed with the sealing bridge 92. The upper margins of the walls 12 and 14 of the bag are joined to the backs of the sealing bridge 92 and the base 102 respectively. The upper margins of the bag film may have short free ends that extend beyond the termination points depicted in FIG. 3, provided that the free ends are not so long as to interfere with travel of the slider along the zipper or become entangled with the zipper profiles.

In a typical zipper, the profile of each male member has a stem flanked by shoulders or teeth, and a tip of the profile points toward the opposing female profile, the tip being the point of the male member furthest away from the base of the profiled structure. Each female profile comprises a pair of gripper jaws extending from a base or root of the female profile. Each jaw comprises a wall and a hook integrally formed at the distal end of the respective wall. The hooks are inclined and generally directed toward each other, the distal ends of the hooks defining a mouth that communicates with a groove defined by the walls and root of the female profile. To open the closed zipper, the zipper parts 6' and 8' are pried apart with sufficient force to pull the heads of the male members out of the female profiles. When the shoulders of the male members clear the hooks of the outwardly flexed gripper jaws, the male and female members are no longer interlocked and the zipper is open.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile.

As seen in FIG. 3, the slider 10' for opening or closing the reclosable zipper is generally shaped so that the slider straddles the zipper profiles. The slider 10' comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The upper margins of the bag walls 12 and 14, which are joined to the backs of the zipper parts 6' and 8', are disposed between the respective zipper parts and the respective side walls 34 and 36 of the slider. The width of the tunnel is substantially constant along the section that is divided by the plow and then narrows from a point proximal to the end of the plow to the closing window at one end face of the slider. The narrowing section of the tunnel is formed by the substantially planar, inclined interior surfaces (not shown in FIG. 3), which converge toward the closing window of the slider. These inclined surfaces funnel or squeeze the zipper parts toward each other, causing the zipper profiles to interlock, as the slider is moved in the closing direction.

The slider 10' also comprises a plow or divider 42 that depends downward from a central portion of the top wall 32 to an elevation below the lowermost portions of each side wall. The plow is disposed between opposing sections of the zipper parts that pass through the tunnel. In the embodiment shown in FIG. 3, a wedge-shaped body 44 is disposed near the distal end of the plow 42. However, the wedge-shaped body is optional. The width of the wedge shape of increases linearly toward the slider top wall 32. The tip of the plow 42 is truncated and has rounded edges and flattened corners at opposing ends for facilitating insertion of the plow between the zipper profiles without snagging.

The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper parts 6' and 8' apart. The plow 42 divides the closing end of the slider tunnel into respective passages for the separated zipper parts to pass through.

The slider 10' further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper parts to increase slider pull-off resistance. The ledges 38 and 40 further comprise respective inclined bottom surfaces 46 and 48 that serve to guide the respective zipper parts 6' and 8' into the slider tunnel during automated insertion of the slider onto the zipper.

In accordance with the embodiment depicted in FIG. 3, a tamper-evident tack seal 22 is formed by fusing a portion of the tip of the male closure element 106 of zipper strip 8' to a confronting portion of the root of the female closure element formed by jaws 98 and 100 of zipper strip 6'. Again, the area of fusion is preferably a circular spot formed in the manner previously described with reference to the embodiment shown in FIG. 2. Alternatively or in addition, a tack seal (not shown in FIG. 3) could be formed between the tip of male closure element 104 and the root of the female closure element formed by jaws 94 and 96. In accordance with further alternatives, the tamper-evident tack seal could be formed by fusing the tip of any one or more of the four jaws 94, 96, 98, 100 of zipper strip 6' to a confronting portion of the base 102 of zipper strip 8'. The location of one such tack seal (where the tip of jaw 94 confronts a portion of base 102) is indicated by arrow 22' in FIG. 3. Again, the tack seal 22' limits travel of the slider 10' as long as the tack seal remains intact, the tack seal being designed to rupture when the separating finger is pushed through with an amount of force that exceeds the force customarily needed to move the slider in a zipper opening direction.

Figure 4:
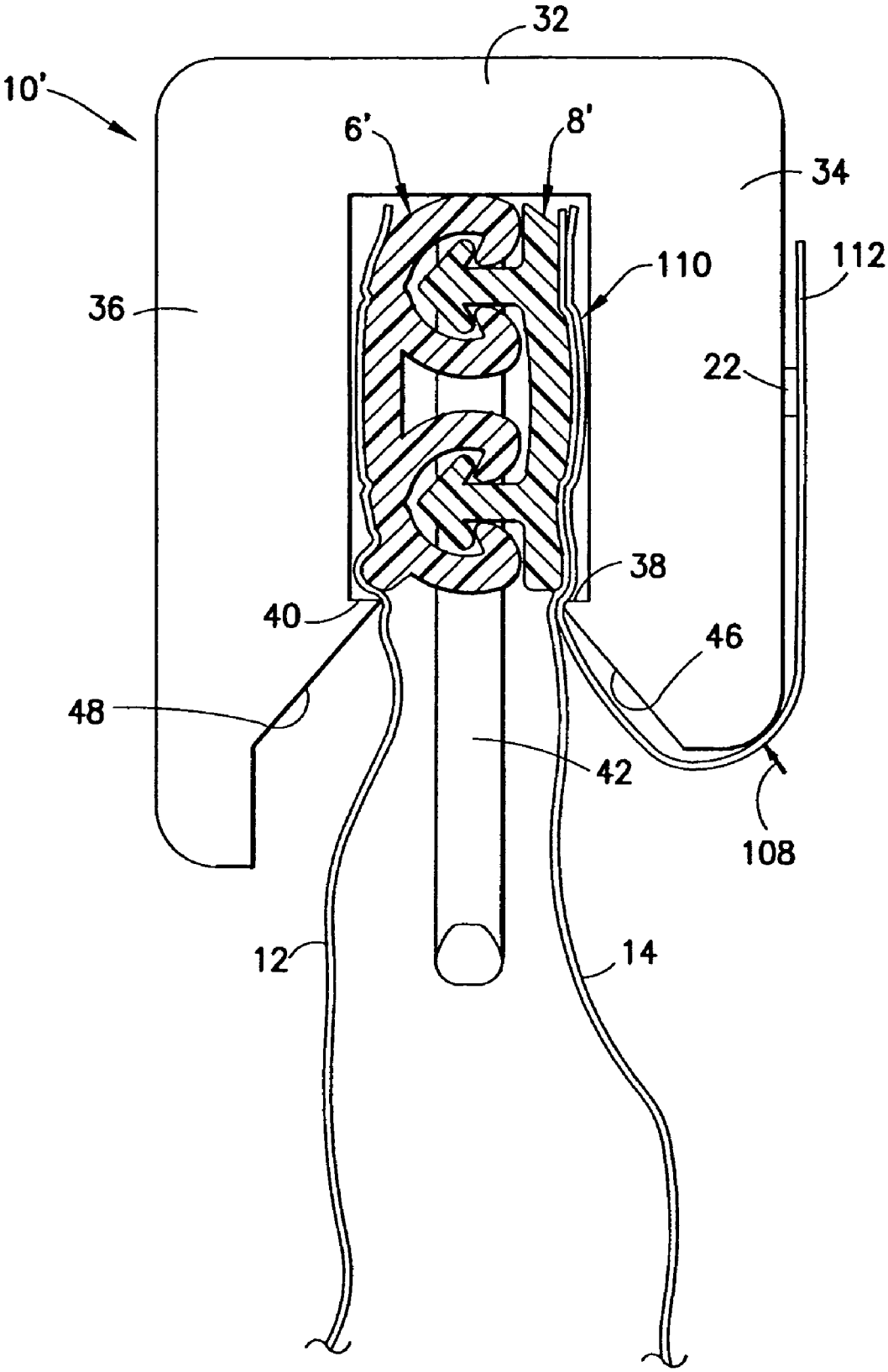
FIG. 4 is a drawing showing a sectional view of the zippered portion of a slider-operated reclosable package wherein the slider is tack sealed to a flap on the package to form a tamper-evident feature that limits slider travel in accordance with a further embodiment of the invention.

A further embodiment of the invention, wherein the slider is tack sealed to a flap on the package to form a tamper-evident feature that limits slider travel, is shown in FIG. 4. For the purposes of illustration, it should be assumed that the slider and zipper have the same constructions as previously described with reference to the embodiment shown in FIG. 3.

In the embodiment depicted in FIG. 4, a portion of a flap 112 is joined, e.g., by conductive heat sealing, to the wall 14 in a band-shaped area indicated by arrow 110. The wall 14 in turn is joined to the back of the zipper strip 8' in the same zone of joinder 110, thus forming a double layer of packaging film disposed between the back of the zipper strip 8' and the side wall 34 of the slider 10'. The free portion of the flap 112 is folded, with the ends of the free portion of the flap being joined to respective zipper end stops (which would be disposed in a manner similar to that depicted for items 24 and 26 in FIG. 1), thereby anchoring both ends of the flap 112. As a result of the folding and sealing operations, a portion of the free portion of the flap 112 will be wrapped under and around the side wall 34 of the slider 10', as depicted in FIG. 4. A tamper-evident tack seal 22 is then formed whereby a spot-shaped portion of flap 112 is tack sealed to the exterior surface of the side wall 34 of slider 10'. Again, this tack seal 22, in conjunction with the flap that is anchored at the fused slider end stops, is designed to resist movement of the slider 10' in a zipper opening direction until tack seal rupture occurs when a threshold force is exceeded. If the flap 112 is made of optically transparent film, then whether or not the tack seal is intact could be visually detectable by the consumer. In that event, the threshold force at which the tack seal ruptures need not be greater than the customary opening force applied by the consumer, since tactile feedback indicating tack seal intactness to the consumer would be unnecessary if visual feedback were provided.

Once the tack seal 22 has been ruptured, it is preferred that any possibly interfering portion of the flap 112 be removed. The majority of the flap 112 can be removed by providing a horizontal tear line at the location indicated by arrow 108 in conjunction with a pair of intersecting vertical tear lines (not shown in FIG. 4) adjacent where the ends of the flap are anchored to the fused slider end stops.

Figure 5:
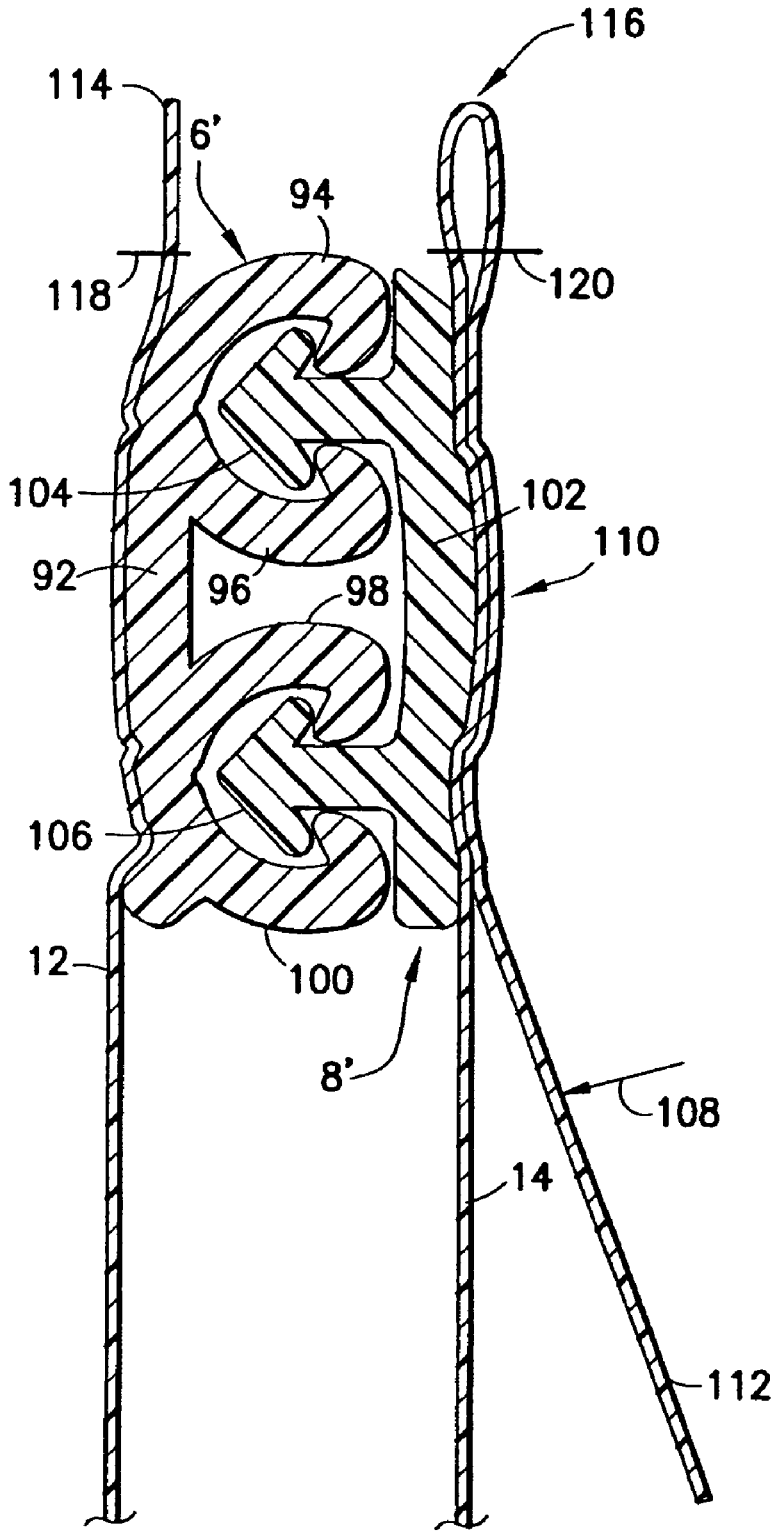
FIG. 5 is a drawing showing a sectional view of a zippered portion of a package precursor at an intermediate stage of manufacture in accordance with the embodiment shown in FIG. 4.

FIG. 5 depicts an intermediate stage in the manufacture of the bag depicted in FIG. 4. A web of bag making film is folded in two places. Only one fold 116 is shown in FIG. 5. However, it should understood that there is another fold at the bottom of the receptacle that connects the front wall 12 to the rear wall 14, both of which are cut off in FIG. 5 in order to maintain a satisfactory scale. In accordance with one method of manufacture, the web of film is perforated or scored to form a line of weakened tear resistance or tear line 108 along the length of the web. The web of film is then folded along a line that is off-center, thus forming the bottom fold (not shown in FIG. 5) and leaving one side of the folded web longer than the other side, with the tear line 108 being located on the longer side. The longer side of the folded web is then folded back along a line that is located approximately directly across from the edge of the shorter side of the folded web, creating a serpentine web profile. That second fold line is designated by the numeral 116 in FIG. 5. The first two legs of the profile (corresponding to walls 12 and 14 of the receptacle) are approximately equal in height, while the third leg is shorter than the other two. This third leg will ultimately be wrapped under and around one side wall of the slider and disposed generally vertically to form the upwardly projecting flap 112 seen in FIG. 4. Initially however, the third leg may extend generally downward in the manner depicted in FIG. 5.

Still referring to FIG. 5, a string zipper, comprising a pair of zipper strips 6' and 8' having complementary profiles, is inserted between opposing portions of the first and second legs of the folded web and near an edge 114 of the first leg of the folded web. The zipper is joined to the web of film by conventional conductive heat sealing using heated sealing bars (not shown in FIG. 5) placed on opposing sides of the assembly. The sealing bars form band-shaped zones of joinder that will extend the full length of the completed package. During this sealing operation, a portion of the first leg (wall 12) of the folded web is sealed to the back of the zipper strip 6', while a portion of the second leg (wall 14) and a portion of the third leg are pressed together and sealed to the back of the zipper strip 8', as shown in FIG. 5. This sealing operation causes the second and third legs of the film structure to merge, forming a double layer 110 of film material joined to the back of the flangeless zipper strip 8'.

FIG. 5 depicts the case wherein an unsealed distal portion of wall 12 extends beyond the zipper strip 6', while an unsealed loop of film at the fold 116 extends beyond the zipper strip 8'. These excess pieces of film are later trimmed off by respective cutting knives (not shown). The respective cuts are indicated by lines 118 and 120 in FIG. 5. The configuration of the zipper-film assembly after the cutting operation can be seen in FIG. 4. The upper margins of the bag walls may have short free ends that extend beyond the termination points depicted in FIG. 4, provided that the free ends are not so long as to interfere with travel of the slider along the zipper or become entangled with the zipper profiles. Alternatively, the distal edge of wall 12 and the fold 116 may be sufficiently aligned with the zipper strips 6', 8' so that no trimming is necessary.

After the zipper has been joined to the film structure and the film (if necessary) has been trimmed, a slider 10' is inserted on the zipper-film assembly as seen in FIG. 4. The slider 10' may have the same construction as that shown in FIG. 3. The upper margin of wall 12 of the film web (which is a single layer of film) is joined to the back of the zipper strip 6' and thus passes through the interstice between zipper strip 6' and the confronting side wall 36 of the slider 10'. On the other side of the zipper, the merged double layer 110 of film material is joined to the back of the zipper strip 8' and thus passes through the interstice between the zipper strip 8' and the other side wall 34 of the slider 10'. The part of the third leg of the film structure that is not joined to the second leg forms the flap 112, which extends downward in proximity to its connection with the double layer 110 of film material, but is otherwise free to be wrapped under and around the adjacent side wall 34 of the slider, as seen in FIG. 4. The ends of the flap 112 are joined to the zipper end stops, e.g., by conductive heat sealing, to anchor the flap and then a spot-shaped area of the flap 112 is joined to a confronting portion of the side wall 34 of the slider 10', e.g., by conductive heat sealing, to form the tack seal 22.

Figure 6:
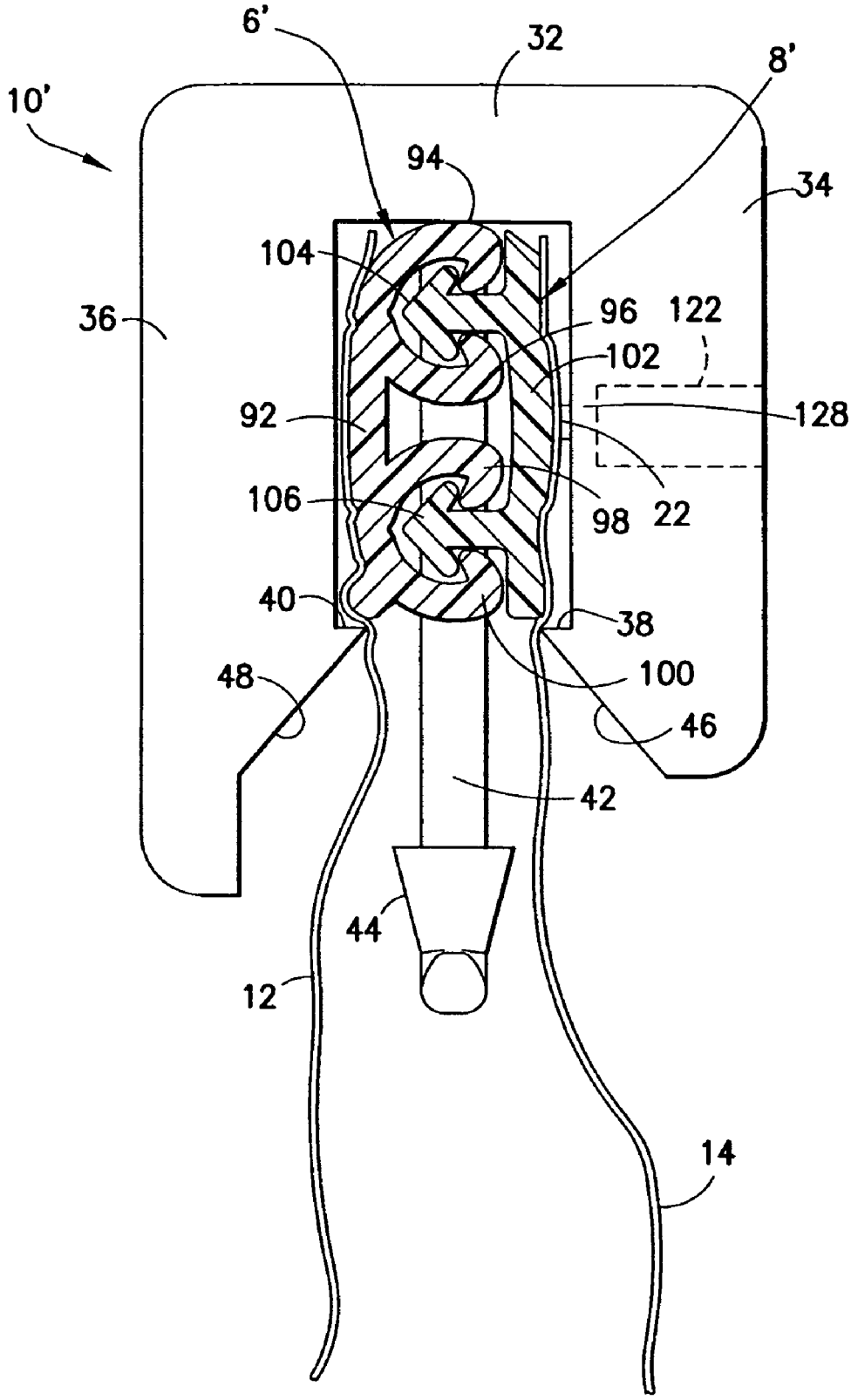
FIG. 6 is a drawing showing a sectional view of the zippered portion of a slider-operated reclosable package wherein the slider is tack sealed to the packaging film to form a tamper-evident feature that limits slider travel in accordance with yet another embodiment of the invention.

FIG. 6 is a sectional view of the zippered portion of a slider-operated reclosable package wherein the slider is tack sealed to the packaging film to form a tamper-evident feature that limits slider travel in accordance with yet another embodiment of the invention. Again the slider and string zipper may be constructed in an identical manner to the slider and zipper previously described in detail with reference to FIG. 3, except that the slider side wall 34 is provided with a recess 122, e.g., in the form of a circular bore that is closed at one end. In accordance with this embodiment, a heated sealing pin or a pin-shaped ultrasonic horn is inserted into the recess 122 and pressed against the thin portion 128 of the side wall 34 disposed at the bottom of the recess 122. The applied heat or ultrasound wave energy is conducted or propagates through the thin portion 128 of the side wall 34, causing a confronting spot-shaped portion of the wall 14 to soften or melt, a tack seal 22 being formed when the softened or melted film material cools and fuses to the interior surface of the side wall 34. Again, this tack seal is designed to resist movement of the slider until the normal opening force is exceeded by the consumer.

Figure 7:
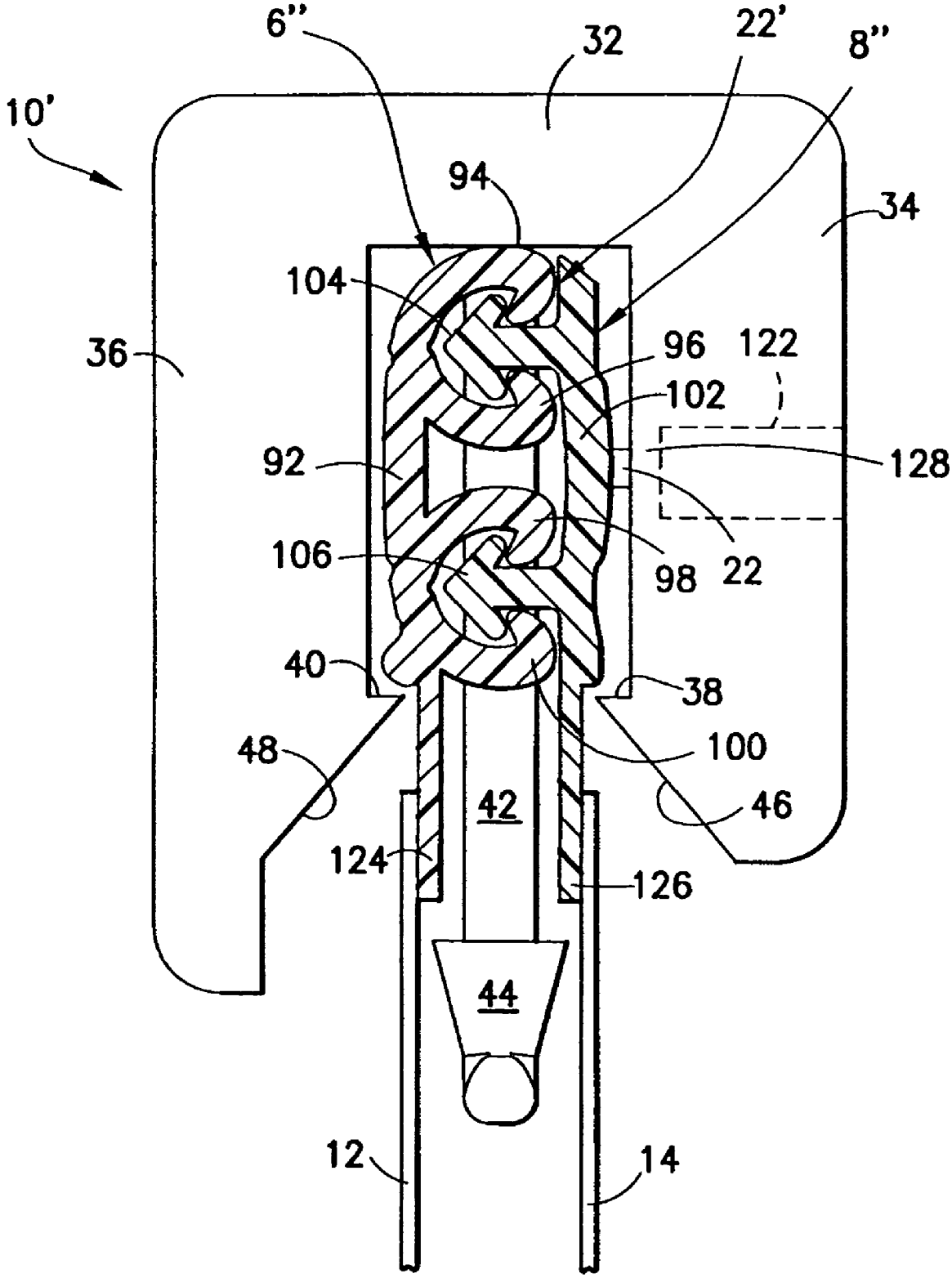
FIG. 7 is a drawing showing a sectional view of the zippered portion of a slider-operated reclosable package wherein the slider is tack sealed to the zipper to form a tamper-evident feature that limits slider travel in accordance with a further embodiment of the invention.

FIG. 7 is a sectional view of the zippered portion of a slider-operated reclosable package wherein the slider is tack sealed to a flanged zipper to form a tamper-evident feature that limits slider travel. The slider 10' may be constructed in an identical manner to the slider previously described in detail with reference to FIG. 6, i.e., the slider side wall 34 is provided with a recess 122, in which a heated sealing pin or a pin-shaped ultrasonic horn can be inserted. In accordance with this embodiment, the zipper comprises a pair of flanged zipper strips 6" and 8". For the sake of simplicity, these zipper strips are shown with closure profiles identical to those of the string zippers previously described. However, instead of the receptacle walls being joined to the backs of the closure profiles, FIG. 7 shows a marginal portion of wall 12 joined to a zipper flange 124 of zipper strip 6" and a marginal portion of wall 14 joined to a zipper flange 126 of zipper strip 8". In this case, the tack seal 22 will comprise a spot-shaped area in which material of zipper strip 8" is fused to the interior surface of the slider side wall 34.

Alternatively, the slider could be constructed to have a thin tongue that projects downwardly from the bottom edge of one side wall, which tongue would be tack sealed to one wall of the receptacle.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" includes bags, pouches, and any other type of packaging in which a flexible plastic zipper can be incorporated. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interengageable zipper strips that have substantially no flange portions. As used in the claims, the term "wall" is used in a broad sense to include both a discrete piece of packaging material and a portion of a folded piece of packaging material. Furthermore, in the absence of explicit language setting forth the order in which certain steps should be performed, the method claims should not be construed to require that steps be performed in the order in which they are recited.

The invention claimed is:

1. A reclosable package comprising:

a receptacle comprising first and second walls, respective mouth portions of said first and second walls forming a mouth that communicates with an interior volume of said receptacle;

a zipper comprising first and second zipper strips, said first zipper strip being joined to said mouth portion of said first wall and said second zipper strip being joined to said mouth portion of said second wall, respective first ends of said first and second zipper strips being inseparable, respective second ends of said first and second zipper strips being inseparable, and confronting portions of said first and second zipper strips disposed between said first and second ends being separable and mutually interengageable;

a slider, having sidewalls defining a channel, mounted to said zipper for causing said confronting portions of said first and second zipper strips to separate when said slider is moved in one direction along said zipper and for causing said confronting portions of said first and second zipper strips to interengage each other when said slider is moved in an opposite direction along said zipper, said slider being parked in a position adjacent said first ends of said first and second zipper strips in an initial configuration; and a rupturable zone of fusion in which a portion of said slider is fused with a confronting portion of said first zipper strip or a confronting portion of said mouth portion of said first wall, disposed within the channel of the slider, said zone of fusion being designed to rupture when said slider is urged to move toward said second ends of said first and second zipper strips with a predetermined threshold level of force.

2. The package as recited in claim 1, wherein said slider comprises first and second side walls, and a portion of said first zipper strip is fused to a portion of said first side wall of said slider in said zone of fusion.

3. The package as recited in claim 1, wherein said first side wall of said slider has a recess that opens on an external surface of said side wall, said recess being aligned with said zone of fusion.

4. The package as recited in claim 1, wherein each of said first and second zipper strips is flangeless.

5. The package as recited in claim 1, wherein said first zipper strip comprises a first base and a first profile projecting from said first base, said second zipper strip comprises a second base and a second profile projecting from said second base, said slider comprises first and second side walls, said mouth portion of said first wall is joined to said first base and is disposed between said first base and said first side wall, said mouth portion of said second wall is joined to said second base and is disposed between said second base and said second side wall, said zone of fusion comprising a portion of said month portion of said first wall and a portion of said first side wall of said slider.

6. A method of providing a tamper-evident feature on a reclosable package having a zipper comprising first and second zipper strips, the first zipper strip being joined to a mouth portion of a first wall of the package and the second zipper strip being joined to a mouth portion of a second wall of the package, respective first ends of the first and second zipper strips being inseparable, respective second ends of the first and second zipper strips being inseparable, and confronting portions of the first and second zipper strips disposed between the first and second ends being separable and mutually interengageable, comprising the steps of:

(a) placing a slider, having sidewalls defining a channel, on the zipper at a location adjacent the first ends of the first and second zipper strips; and (b) fusing a portion of the slider with a confronting portion of said the zipper strip or a confronting portion of the mouth portion of the first wall, disposed within the channel of the slider, in a zone of fusion, wherein the zone of fusion is designed to rupture when the slider is urged to move toward the second ends of the first and second zipper strips with a predetermined threshold level of force.

7. The method as recited in claim 6, wherein said fusing step comprises inserting an end of a heated pin in a recess formed in a side wall of the slider.

8. The method as recited in claim 6, wherein said fusing step comprises inserting end of an ultrasonic horn in a recess formed in a side wall of the slider.

* * * * *